United States Patent [19]

Zeman

[11] Patent Number: 4,801,089

[45] Date of Patent: Jan. 31, 1989

[54] SPRINKLER STRUCTURES HAVING REPLACEABLE WATER DISTRIBUTION STRUCTURES

[76] Inventor: David G. Zeman, P.O. Box 42040, Las Vegas, Nev. 89116

[21] Appl. No.: 37,932

[22] Filed: Apr. 13, 1987

[51] Int. Cl.[4] ..... B05B 15/06

[52] U.S. Cl. ..... 239/276; 239/396; 239/504; 239/524; 239/533.1; 239/600

[58] Field of Search ..... 239/273, 276, 280, 280.5, 239/390, 391, 396, 397, 504, 505, 510, 516, 533.1, 568, 600, 524

[56] References Cited

U.S. PATENT DOCUMENTS

| | | | |
|---|---|---|---|
| 1,086,288 | 2/1914 | Gibbs | 239/516 |
| 1,434,757 | 11/1922 | Thomas | 239/504 |
| 1,830,833 | 11/1931 | Green | 239/276 |
| 2,569,992 | 10/1951 | Hopwood | 239/505 |
| 2,721,764 | 10/1955 | Wilson, Jr. | 239/600 |
| 3,385,525 | 5/1968 | Jacobs | 239/276 |
| 3,700,174 | 10/1972 | Beck | 239/280 |
| 4,130,247 | 12/1978 | Healy | 239/396 |
| 4,256,262 | 3/1981 | Rosenberg et al. | 239/276 |
| 4,660,765 | 4/1987 | Rosenberg | 239/390 |

FOREIGN PATENT DOCUMENTS

| | | | |
|---|---|---|---|
| 31846 | 6/1923 | Denmark | 239/568 |
| 1090426 | 3/1955 | France | 239/600 |

*Primary Examiner*—Andres Kashnikow
*Assistant Examiner*—Michael J. Forman

[57] ABSTRACT

A sprinkler structure for use in agricultural and horticultural applications can be constructed so that it includes a support having a resilient arm structure for holding a distribution member so that the distribution member can be easily removed from and replaced on the support. This makes it possible to easily remove and replace the distribution member for cleaning purposes. It also makes it possible to easily substitute one distribution member for another when a change in distribution members may be desired.

10 Claims, 1 Drawing Sheet

SPRINKLER STRUCTURES HAVING REPLACEABLE WATER DISTRIBUTION STRUCTURES

BACKGROUND OF THE INVENTION

The invention set forth in this specification pertains to new and improved sprinkler structures. More specifically it pertains to sprinkler structures which include water distribution, discharge or spray structures and which are constructed so that such distribution structures can be easily removed and replaced for cleaning purposes or exchanging one such distribution structure for another.

The sprinkler structures of this invention are intended primarily to be used for agricultural and horticultural purposes. Normally they are employed to distribute a comparatively small volume of water from a supply of distribution tube or manifold to the area immediately surrounding them. Not infrequently it is desirable or necessary to change the nature of the spray of water produced by or obtained from the use of such a sprinkler structure so that the spray will cover a different area than before or so that the spray will be of a different character than before. Also it is rather common to have to clean out accumulations of various sorts within such spray structures so that they will operate satisfactorily.

As a result of these considerations a number of different types of sprinkler structures have been developed which use easily replaceable discharge or spray structures to create various different sprays or spray patterns. Unfortunately it is not considered that one of these prior structures is completely desirable or acceptable for common agricultural or horticulturist purposes for one or more of a series of reactions. This is best illustrated by referring to various different types of known sprinkler structures having easily replaceable distribution or spray structures.

For discussion purposes it can be considered that those of such prior sprinkler structures which are of the most significance in connection with this invention fall within three different groups or classifications: (1) those using a wire bail to hold a distribution port or spray structure so that it can be easily detached from or replaced on a sprinkler structure; (2) those using a post extending above and/or over a discharge opening or nozzle to hold a distribution or spray structure opposite the opening of the nozzle; and (3) those using a post extending along side of a stream from such an opening or discharge nozzle to hold a distribution structure so that it can be adjusted along the length of the post to various positions in alignment with the discharge opening or nozzle.

It will be recognized that this listing of three different types or manners of constructing sprinkler structures having replaceable distribution, discharge or spray structures does not designate all of the multitude of various different types of sprinklers or sprinkler structures which have been developed so as to include removable or replaceable distribution or spray structures. This can be illustrated by referring to sprinkler structures having sprinkler heads which can be screwed into and out of a socket for replacement purposes. These are not considered to be particularly significant with respect to the present invention because in general they are not as easy to manipulate in removing and replacing distribution or spray structures as those constructed as indicated in the preceding discussion. Also as a class such structures using threads are considered to tend to be more expensive than sprinkler structures as indicated in the preceding discussion.

Those sprinkler structures which use a wire bail are unquestionably utilitarian in character in that they are constructed in such a manner as to permit rapid, easy removal and replacement of the distribution part of a structure such as a spray or deflector head. In spite of this it is considered that in general they are not desirable for many agricultural and horticultural uses in which small or limited volumes of water are discharged because of the cost of such structures. This is related to the fact that the bail in such a structure has to be of a comparatively large diameter wire if it is to be strong enough to adequately operate in holding a distribution structure such as a spray head in place in such a structure.

The use of a comparatively large bail is undesirable because of cost and weight considerations. On the other hand if a comparatively small wire bail is used it will not have the desired strength characteristics. Also any comparatively inexpensive wire bail is subject to corrosion. Further, known sprinkler structures of this bail type are constructed in such a manner that only limited types of spray heads or other water distribution or spray structures can be used with them.

With sprinkler structures of the other types indicated in the preceding which are constructed for use in spraying comparatively small volumes of water, corrosion problems such as are inherent with normal steel wire bails are avoided by forming all or substantially all of the parts of such structures of common, relatively inert thermoplastic polymers. In general sprinkler structures of these other two types are relatively inexpensive because of this. However, known sprinkler structures of these other types are designed in such a way that functional problems tend to be encountered with them.

For example, those sprinkler structures of the second of the classes indicated in the preceding are limited in that they cannot be effectively used with discharge structures or heads of such a type that all of the water passing through a sprinkler structure has to pass through a nozzle, a slit, a series of either of these or the like in the discharge structure or head but instead are designed so as to be employed only with discharge structures using one or more deflecting surfaces designed to receive and deflect a stream of water from a nozzle or nozzle-like discharge opening. While in some applications it may not be necessary or desirable to use other than a deflecting type distribution structure in others it is considered the need to use such another type of structure is significant.

It is also considered significant that in any sprinkler structure of the second and third types indicated in the preceding discussion there is normally a need for the precise placement of the deflecting surface relative to the nozzle or nozzle-like discharge opening. There are two aspects of such placement: (1) the alignment of the deflecting surface with a nozzle or opening; and (2) the correct spacing between the deflecting surface and the nozzle or opening. If both of these factors are not considered there is a reasonable possibility that a desired spray will not be obtained. Many of the various sprinkler structures of the last two of the types noted are considered to be normally constructed in such a manner that it may be difficult to consistently achieve the desired placement of the deflecting surfaces in the distribution structures employed in such units, particularly under field conditions.

In the latter circumstances individuals are not apt to spend the time to make sure that any distribution structure is precisely installed in a desired manner in a sprinkler or sprinkler structure. Such installation is believed to normally be important in connection with plastic sprinklers in which the distribution or discharge member containing a deflecting surface is frictionally held in place after the insertion of a small shaft in a correspondingly sized hole. With the latter and related structures in which only friction is used or is used in conjunction with a small detent to hold or deflector or the like in place it is considered that there is always a degree of danger of the deflecting surface in such a structure either not being properly positioned or of getting out of position as a result of ambient conditions.

BRIEF SUMMARY OF THE INVENTION

It is believed that it will be apparent from the preceding discussion that there is a need for new and improved sprinkler structures and, more specifically, low cost sprinkler structures which use water distribution, discharge or spray structures and which are constructed so that such distribution structures can be easily removed and replaced for cleaning purposes or in exchanging of such distribution structures. The invention is intended to supply sprinkler structures to meet this need.

The sprinklers or sprinkler structures of this invention are primarily intended to be used for various agricultural and horticultural water applications in which comparatively small or limited quantities of water are distributed in order to promote plant growth. In this field cost is not the only important consideration. It is important to have sprinkler structures which will function satisfactorily for comparatively long periods without any maintenance other than routine cleansing, which are comparatively small and light in weight so that they can be easily shipped and handled in bulk and which are easily installed in virtually any desired manner.

In accordance with this invention these various objectives are achieved by providing a sprinkler structure having a support means for holding the parts of the sprinkler structure relative to one another, inlet means on said support means, said inlet means including an inlet passage which is intended to be connected to a water supply structure, an inlet into said inlet passage and an outlet from said inlet passage, said sprinkler structure also including distribution means for distributing water from said sprinkler structure located so as to receive water from said outlet of said inlet passage, said sprinkler means further including holding means for holding said distribution means on said support means so that said distribution means receives water from said outlet of said inlet passage, in which the improvement comprises: said inlet means includes a first seat for forming a seal around said outlet of said inlet passage, said distribution means is shaped so as to include an internal passage having an inlet and an outlet and so as to include a second seat surrounding said inlet to said internal passage which is complimentary in shape to the shape of said first seat so as to be capable of fitting against said first seat so as to form a seal, and said holding means comprises resilient biasing means engaging said distribution means so as to bias said second seat into engagement with said first seat.

BRIEF DESCRIPTION OF THE DRAWING

Because of the nature of this invention it is best more fully explained with reference to the accompanying drawing in which.

Figure 1:
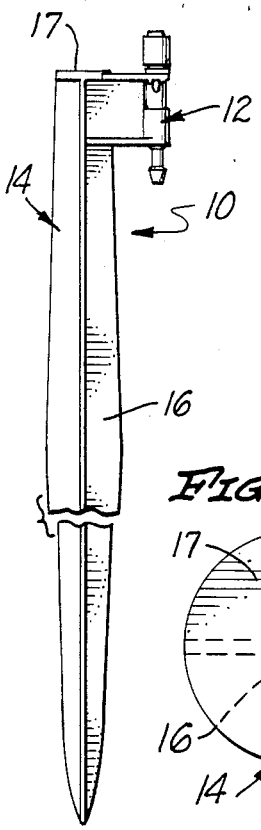
FIG. 1 is a side elevational view of a presently preferred embodiment or form of a sprinkler structure or sprinkler of the invention.
Figure 2:
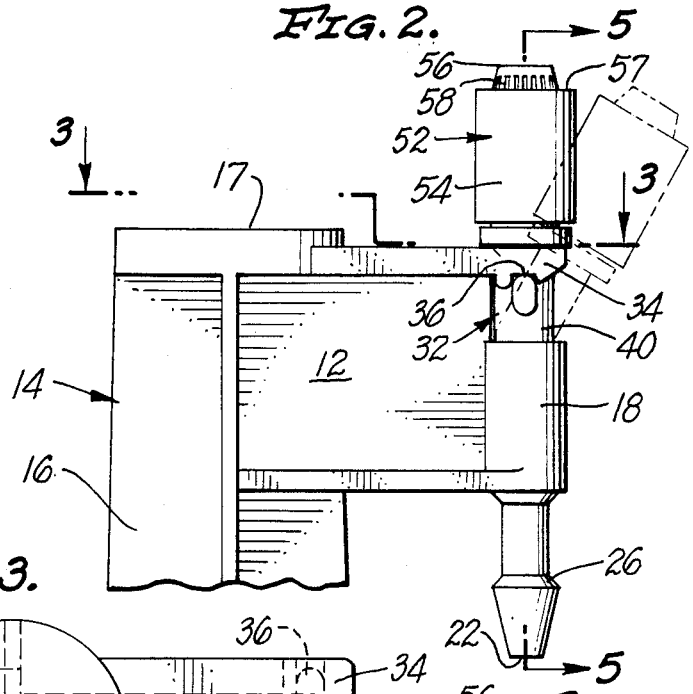
FIG. 2 is an enlarged partial side elevational view corresponding to part of FIG. 1 in which a distribution structure forming a part of the complete sprinkler structure is shown in phantom in a position it would be in during the disassembly or assembly of this distribution structure.
Figure 3:
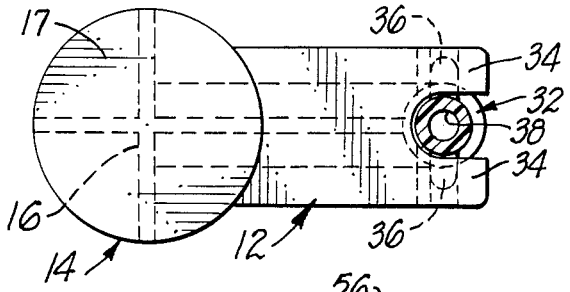
FIG. 3 is a cross-sectional view taken at line 3—3 of FIG. 2.
Figure 4:
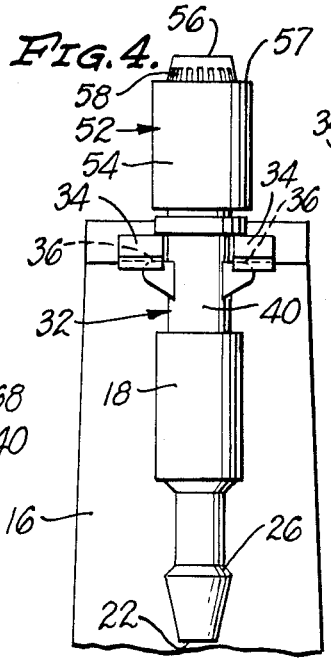
FIG. 4 is a front elevational view of the part of the sprinkler structure illustrated in FIG. 2.

It is to be understood that a number of differently appearing and differently constructed complete sprinkler structures and distribution structures for use as parts of such sprinkler structures can be made in accordance with the concepts of this invention through the use of routine engineering skill on the basis of the disclosure embodied within this specification. For this reason the invention is to be considered as being limited solely by the appended claims forming a part of this specification. These concepts are set forth and defined in these claims.

DETAILED DESCRIPTION OF THE PREFERRED EMBODIMENT

In the drawing there is shown a sprinkler structure or sprinkler 10 in accordance with this invention which utilizes a central body portion 12 serving as a part of a complete support or support means 14 which is used in holding various parts of the structure 10 as subsequently described and in mounting this structure 10. Although a variety of different, known mounts or mounting structures can be used with the sprinkler structure 10 it is preferred to use a mount or mounting structure 16 which is shaped as a common stake having a hammer pad 17 enabling this stake 16 to be hammered into the ground so that the structure can be conveniently located by pushing this stake 16 into the ground (not shown) at any desired location. Preferably the entire support 14 and the stake 16 are integrally formed of an inert, self supporting resilient polymer material.

The body portion 12 includes a vertically extending cylinder 18 having an internal, stepped inlet passage 20. The passage 20 includes an inlet 22 and an outlet 24 located above this inlet 22. If desired the outlet 24 can be shaped as shown so as to serve as a nozzle which will pass a predetermined amount of water at a specified pressure. Preferably, but not necessarily, a known pressure regulator 25 is located within the passage 20 as shown. The particular regulator 25 shown is a perforated, deformable elastomeric disk. It can be used to insure that a uniform spray pattern is achieved even when there are variations in the pressure of the water supplied to the sprinkler structure 10.

Preferably a known, tapered external flange 26 is located on the cylinder 18 adjacent to the inlet 22 for the purpose of holding the end of a water distribution tube (not shown) so that it communicates with the passage 20. If desired conventional equivalents can be substituted for the flange 26 so that the structure 10 can be directly connected to a wall of a comparatively large tube or manifold (not shown) used to supply water to this structure 10. A beveled seat 28 is provided on the cylinder 18 around the outlet 24.

Figure 5:
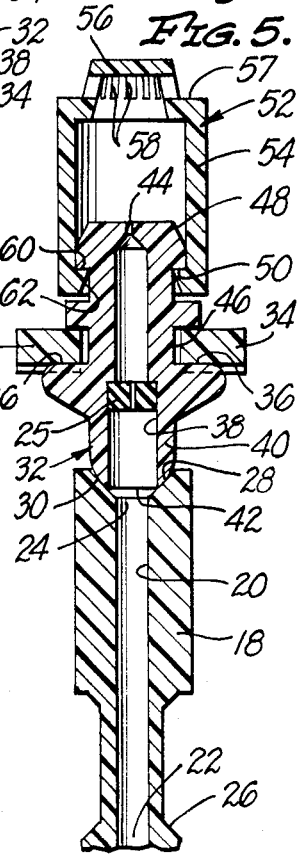
FIG. 5 is a partial cross-sectional view taken at line 5—5 of FIG. 2.

This seat 28 and another seat 30 on a distribution structure or means 32 are of a complimentary shape such that they will fit against one another as shown in FIG. 5 in order to form a seal. These seats 28 and 30 are normally held against one another as shown through the use of generally parallel resilient arms 34 located so as to extend from the body portion 12 in such a manner as to rest against aligned shoulders 36 on a bottom part 40 of the distribution structure 32 so as to bias the distribution structure 32 generally toward the cylinder 18. This part 40 may be referred to as a jet cap base. Although the arms 34 may be separate members attached to the body portion 12 preferably they are molded integrally with this body portion 12. These arms 34 may be referred to as "clip means" for holding the structure 32.

When the distribution structure 32 is held as described an internal passage 38 through the bottom part 40 of the distribution structure 32 is located so that an inlet 42 into it is in communication with the outlet 24 from the inlet passage 24. It will be noted that the shoulders 36 are located on this part 40 and that both the part 40 and the passage 38 extend between the arms 34 as illustrated and so that the outlet 44 from the passage 38 is located above the arms 34. If desired a peripheral groove 46 may be located around the part 40 so as to accommodate the arms 34 in such a manner that this part 40 is reasonably secure against being accidentally dislodged when it is located as shown.

A tapered end 48 leading to a peripheral, radially extending flange 50 is preferably located adjacent to and more or less around the outlet 44 so that any desired water discharge or deflecting structure or spray cap can be easily mounted on or removed from the bottom part 40. In the embodiment of the sprinkler structure 10 shown in FIGS. 1–5 a water discharge structure 52 is employed. The structure 52 may be referred to as the top part 52 of the distribution structure 32. It is preferably formed of a self supporting, resilient polymer so as to include a vertically extending cylinder 54 having a known spray head 56 enclosing a top end 58 of this cylinder 54. Various conventional slots 58 serving as discharge nozzles to create a spray (not shown) are located in this head 56.

A small internal flange 60 having a tapered entrance 62 is located on the cylinder 54 so that this cylinder 54 can be "snapped" or "popped" onto the bottom part 40 as shown in order to completely assemble the sprinkler structure 10 so that it can be used in spraying water. If during such use the slots 58 should become clogged the entire discharge structure 52—ie. the cylinder 54—can be snapped off of the bottom part 50 so that it can be cleaned. After cleaning it can be snapped back in place just as easily as it was originally removed. Or, if it should be desired the entire distribution structure 32 can be removed for cleaning and replaced just as easily if either the slots 58 or the disk 25 should become clogged by moving it upwardly slightly against the pressure of the arms 34 until it can be pulled away from the remainder of the structure 10.

During any removal of either the distribution structure 32 or of a discharge structure 52 a different distribution structure 32 or a different discharge structure 52 can be substituted for the removed structure. This may be desirable when it is desired to change the nature of a spray pattern of water distributed using the sprinkler structure 10 or when it desired to utilize a different type of distribution structure 32 than had been previously employed. At times it may also be desirable to change the regulator or disk 25.

Figure 6:
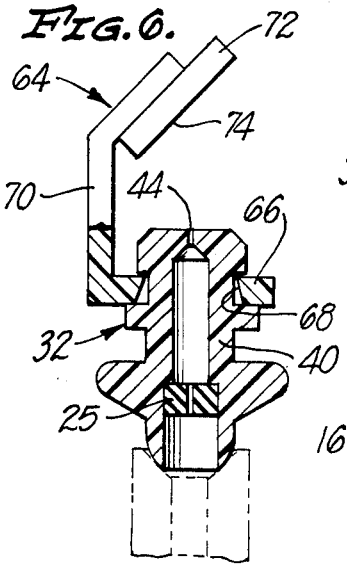
FIG. 6 is a view which is partially in section corresponding to part of FIG. 2 showing the sprinkler structure illustrated in the preceding figures with a different distribution structure than shown in the preceding figures.

One such different distribution structure is the distribution structure 64 indicated in FIG. 6 of the drawing. It includes a bottom ring 66 having a tapered inlet 68 which is designed to facilitate it being located on the bottom part 40 in the same manner in which the distribution structure 52 is located in place. A vertically extending post 70 integral with the ring 66 is located so as to extend upwardly from the ring 66. The distribution structure 64 uses a deflector member 72 carried by the post 70. This member 72 has a deflecting surface 74 located so that water emitted from the outlet 44 will hit against it so as to be defected outwardly. This distribution structure 64 can be replaced or cleaned in the manner previously described.

I claim:

1. A sprinkler structure having a support means for use in holding said sprinkler structure, inlet means on said support means, said inlet means including an inlet passage which is intended to be connected to a water supply structure, an inlet into said inlet passage and an outlet of said inlet passage, said sprinkler structure also including distribution means for distributing water from said sprinkler structure, said distribution means being located so as to receive water from said outlet of said inlet passage, said sprinkler structure further including holding means for holding said distribution means on said support means so that said distribution means is capable of receiving water from said outlet from said inlet passage, in which the improvement comprises:

said inlet means includes a first seat for forming a seal around said outlet of said inlet passage, said distribution means is shaped so as to include an internal passage having an inlet and an outlet and so as to include a second seat surrounding said inlet to said internal passage which is complimentary in shape to the shape of said first seat so as to be capable of fitting against said first seat so as to form said seal, said distribution means includes shoulder means for use in holding said distribution means so that said seats are in engagement so as to form said seal, said holding means resiliently engages said shoulder means so as to permit the removal and replacement of said distribution means, said shoulder means comprises two shoulders located on opposite sides of said distribution means intermediate the longitudinal ends thereof, and said holding means comprises two resilient arms, one of said arms engaging one of said shoulders, the other of said arms engaging the other of said shoulders so as to bias said second seat into engagement with said first seat, and said holding means and said support means are integral with one another and are formed of a self supporting, resilient, inert polymer composition.

2. A sprinkler structure as claimed in claim 1 including: deformable pressure compensating means for controlling the pressure of water to be distributed by said sprinkler structure, said pressure compensating means being located on said distribution means.

3. A sprinkler structure as claimed in claim 1 wherein:

said distribution means includes a peripheral groove shaped so as to accommodate said arms so as to secure said distribution means against being accidentally dislodged.

4. A sprinkler structure as claimed in claim 3 including:

deformable pressure compensating means for controlling the pressure of water to be distributed by said sprinkler structure, said pressure compensating means being located on said distribution means.

5. A sprinkler structure as claimed in claim 1 wherein:

said distribution means includes a bottom part which is adapted to be held by said holding means and a top part detachable mounted on said bottom part, and said top part including means for discharging water from said sprinkler structure located so that water passing through said distribution means is directed away from said sprinkler structure by said means for discharging water.

6. A sprinkler structure as claimed in claim 5 wherein:

said top part is sufficiently resilient and said top and bottom parts are shaped so that said top part is capable of being snapped on and off of said bottom part, and said means for discharging water comprises a head having at least one discharge opening located therein.

7. A sprinkler structure as claimed in claim 5 wherein:

said top part is sufficiently resilient and said top and bottom parts are shaped so that said top part is capable of being snapped on and off of said bottom part, and said means for discharging water comprises at least one surface located relative to said outlet of said distribution means so as to deflect water which passes through said outlet of said distribution means.

8. A sprinkler structures as claimed in claim 5 wherein:

said distribution means includes a peripheral groove shaped so as to accommodate said arms so as to secure said distribution means against being accidentally dislodged.

9. A sprinkler structure as claimed in claim 8 wherein:

said top part is sufficiently resilient and said top and bottom parts are shaped so that said top part is capable of being snapped on and off of said bottom part and said means for discharging water comprises a head having at least one discharge opening located therein.

10. A sprinkler structure as claimed in claim 8 wherein:

said top part is sufficiently resilient and said top and bottom parts are shaped so that said top part is capable of being snapped on and off of said bottom part and said means for discharging water comprises at least one surface located relative to said outlet of said distribution means so as to deflect water which passes through said outlet of said distribution means.

* * * * *